United States Patent [19]

Sumiyoshi et al.

[11] 4,206,599

[45] Jun. 10, 1980

[54] INTERNAL COMBUSTION ENGINE

[75] Inventors: Masaharu Sumiyoshi; Setsuro Sekiya; Katsuhiko Motosugi, all of Toyota; Junzo Uozumi, Nagoya; Tsuneo Ando, Chiryu; Yuzo Takeuchi; Mikio Minoura, both of Nagoya, all of Japan

[73] Assignees: Toyota Jidosha Kogyo Kabushiki Kaisha, Toyota; Aisan Industry Co., Ltd., Ohbu, both of Japan

[21] Appl. No.: 939,984

[22] Filed: Sep. 6, 1978

[30] Foreign Application Priority Data

Sep. 7, 1977 [JP] Japan ..... 52-107435

[51] Int. Cl.[2] ..... F01N 3/10

[52] U.S. Cl. ..... 60/285; 60/290; 123/33 E; 123/119 D; 123/139 AW

[58] Field of Search ..... 60/290, 285; 123/33 B, 123/33 C, 33 E, 119 DB, 119 D, 124 R, 139 AW

[56] References Cited

U.S. PATENT DOCUMENTS

| | | | |
|---|---|---|---|
| 3,751,916 | 8/1973 | Hayashida | 123/119 DB |
| 3,782,639 | 1/1974 | Boltz | 123/139 AW |
| 3,826,233 | 7/1974 | Mennesson | 123/139 AW |
| 4,007,718 | 2/1977 | Laprade | 60/285 |
| 4,167,161 | 9/1979 | Nakagama | 123/119 DB |

*Primary Examiner*—Douglas Hart

*Attorney, Agent, or Firm*—Cushman, Darby & Cushman; Cushman, Darby & Cushman

[57] ABSTRACT

An internal combustion engine has a secondary air supply system and a fuel injection system including a two-fluid injection nozzle operative to inject air and fuel both under pressure into engine intake system. The secondary air supply system includes an air pump and a secondary air supply line extending between the pump and the engine exhaust system. The two-fluid injection nozzle is pneumatically connected to an air distributor provided on the secondary air supply line whereby pressurized air from the air pump is also supplied to the two-fluid injection nozzle and injected thereby together with the fuel to facilitate atomization of the injected fuel as well as to supercharge the engine.

17 Claims, 2 Drawing Figures

INTERNAL COMBUSTION ENGINE

Figure 1:
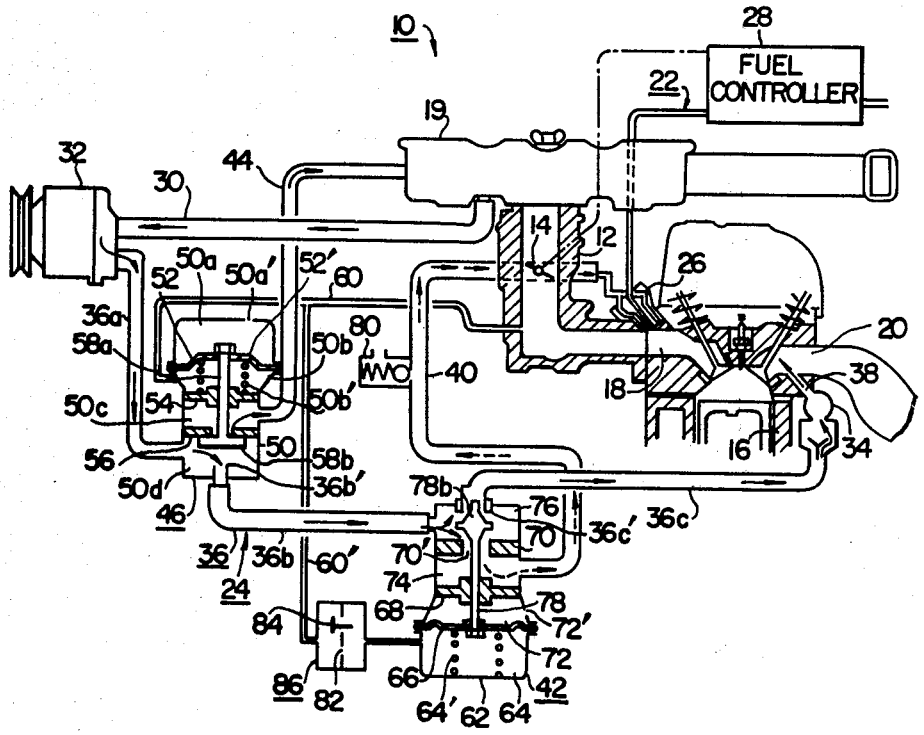

The present invention relates to an internal combustion engine and, more particularly, to an internal combustion engine of the type that comprises a secondary air supply system for introducing a secondary air into an exhaust system of the engine for the purification of the engine exhaust gases and a fuel injection system for injecting a fuel in liquid phase into an intake system of the engine.

The injection type of fuel supply system is more advantageous than the carburetor type fuel supply system in the view point of properly controlling and adjusting the air-fuel ratio of mixture charges to an associated internal combustion engine all over various operating conditions of the engine. The injection type of fuel supply system, therefore, has been used in many gasoline engines. The fuel supply system of this type, however, encounters poor atomization and evaporation of the fuel injected at a low engine temperature.

On the other hand, it has been conventional to provide an engine with a secondary air supply system for the purification of the engine exhaust gases. The secondary air supply to the engine exhaust system is not at a constant rate throughout all the operating conditions of the engine but at various rates in dependence on the engine operating conditions. However, because an air pump for producing pressurized air for the secondary air supply is driven by the associated engine, the discharge of the air pump is substantially in proportion to the engine speed. Thus, an excess amount of pressurized air is produced by the air pump in a high or full-load engine operating condition in which no secondary air or only a small amount of secondary air is required for the exhaust gas purification. The excess amount of pressurized air has heretofore been either fed back into an air cleaner or discharged into the atmosphere.

It is an object of the present invention to utilize the excess amount of pressurized air so as to facilitate the atomization of fuel inejcted by a fuel injection system thereby for improving the vaporization of the injected fuel.

So as to achieve this object, the present invention provides an internal combustion engine comprising a secondary air supply system including an air pump for pressurizing air and a secondary air supply line through which the pressurized air is supplied as a secondary air into the engine exhaust system, and a fuel injection system including at least one injector disposed in the engine intake system and a fuel source operative to feed a fuel under pressure to the injector, wherein the injector is formed by a two-fluid injection nozzle operative to inject the fuel under pressure together with air, and wherein an air distributor is provided on the secondary air supply line between the ends thereof and the two-fluid injection nozzle is pneumatically connected to the air distributor by a branch air line, the air distributor being operative to cause the pressurized air to flow through the branch air line to the two-fluid injection nozzle at least in a high-load engine operating condition.

Preferably, the air distributor may comprise an air distributing valve operative in response to variation in the engine intake vacuum to control the distribution of the pressurized air to the engine exhaust system and to the two-fluid injection nozzle and may be arranged such that the distribution of the pressurized air to the engine exhaust system is increased as the engine intake vacuum is increased and such that the distribution of the pressurized air to the two-fluid injection nozzle is increased as the engine intake vacuum is decreased. The air distributing valve if arranged as discussed above will assure that the rate of the pressurized air supply to the engine exhaust system is increased in a part-load engine operating condition in which the engine intake vacuum is at a high level and that the rate of the pressurized air supply through the two-fluid injection nozzle into the engine is increased in a high or full-load engine opearing condition in which the engine intake vacuum is at a low level, thereby to facilitate the atomization of the fuel and to increase the supercharging effect on the engine.

The branch air line may have a portion arranged such that the pressurized air flowing therethrough is in heat exchange relationship to a heat source, such as the engine cooling water or engine exhaust gases, so that the pressurized air fed to the two-fluid injection nozzle is advantageously heated by the heat source to further improve the atomization and vaporization of the fuel injected together with the heated air.

A change-over valve may preferably be disposed on the branch air line between the ends thereof and an atmospheric air conduit may be connected at one end to the change-over valve. The change-over valve may preferably be arranged such that the change-over valve communicates the atmospheric air conduit with the two-fluid injection nozzle in part-load engine operating condition in which the engine intake vacuum is at a high level and such that the change-over valve is changed over to cause the pressurized air from the air pump to flow to the two-fluid injection nozzle in a high-load engine operating condition in which the engine intake vacuum is at a low level.

Preferably, a cut-off valve may be provided on the secondary air supply line between the air pump and the air distributor for interrupting the communication between the air pump and the air distributor on an abrupt deceleration of the engine thereby to cut off the supply of the pressurized air to the engine exhaust system.

The above and other objects, features and advantages of the present invention will be made apparent by the following description with reference to the accompanying drawings.

Figure 2:
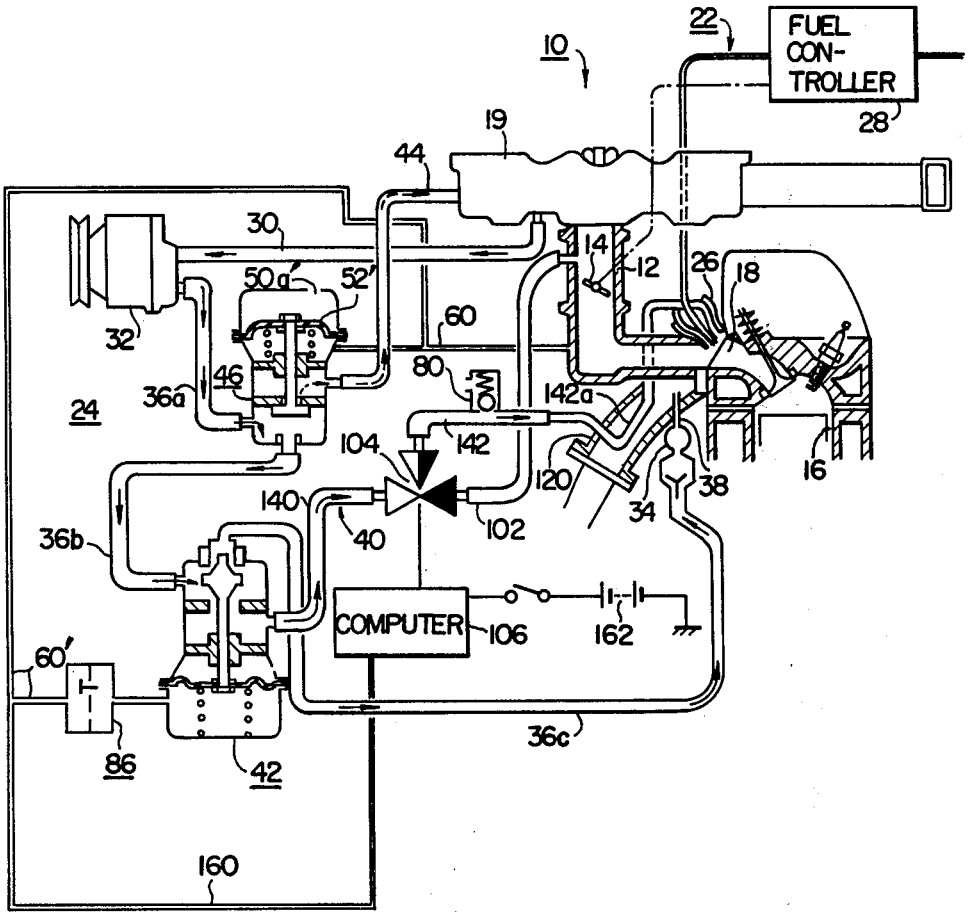

FIGS. 1 and 2 are partly sectional diagrammatic views of the first and second embodiments of an internal combustion engine according to the present invention, respectively.

FIG. 1 diagrammatically illustrates a first embodiment of an internal combustion engine 10 of the present invention which is of a type that includes a fuel injection system 22 and a secondary air supply system 24.

The fuel injection system 22 comprises an injector 26 through which a fuel is continuously injected into an intake system of the engine downstream of a throttle valve 14 disposed in an intake passage 12 of the engine, and a fuel controller 28 operative to meter the fuel in dependence on the operating condition of the engine and feed the metered fuel to the injector 26. The fuel is supplied from a pressurized fuel source (not shown) at a predetermined pressure level higher than the atmospheric pressure. The fuel controller 28 is of a conventional structure and operative in response to variation in the engine operating condition represented by variation in the rate of intake air flow into the engine. In the illustrated embodiment of the invention, one injector 26 is provided for an intake port 18 of each engine cylinder 16. This feature, however, is not essential for the invention. A single or a pair of injectors having the capacity larger than that of the illustrated injector 26 may alternatively be disposed in the intake passage 12 either between the intake port 18 and the throttle valve 14 or upstream of the throttle valve 14. The injector 26 employed in the illustrated embodiment of the invention comprises a so-called "two-fluid injection nozzle" which is operative to inject the fuel from the fuel controller 28 and a pressurized air in such a manner that the injected fuel and air impinge upon each other at a large relative velocity and are effectively and reliably mixed together whereby the fuel is well atomized and evaporated. A two-fluid injection nozzle operative as such is well known by those in the art and disclosed in Japanese Post-Examination Patent Publication No. 48-5327 (5327/73) published in 1973. The pressurized air to be injected together with the fuel through the fuel controller 28 is supplied in a manner to be described later.

The secondary air supply system 24 is operative to introduce a pressurized air into an exhaust system of the engine 10 for the purification of the engine exhaust gases in known manner. In the illustrated embodiment of the invention, the secondary air supply system 24 includes an air pump 32 driven in a known manner by the engine 10 to suck air through a conduit 30 from an air cleaner 19 of the engine, an air injection manifold 34 disposed adjacent to the engine exhaust system, a secondary air supply line 36 for feeding the pressurized air from the air pump 32 to the air injection manifold 34 and a plurality of air injection nozzles (one of which is shown as at 38) for injecting the pressurized air from the air injection manifold 34 into exhaust ports 20 of the engine 10.

A branch line 40 is connected at one end to the secondary air supply line 36 between the air pump 32 and the air injection manifold 34 and has the other end connected to the two-fluid injection nozzle 26. At the point of connection between the line 36 and the line 40 is disposed an air distributor 42 which is operative to control the air supplies to the air injection manifold 34 and to the two-fluid injection nozzle 26 in dependence on the engine operating condition. A two-way changeover valve 46 is provided on the secondary air supply line 36 between the air distributor 42 and the air pump 32 and operative to interrupt the supply of the pressurized air to the air distributor 42 and to return the air through an air return conduit 44 back into the air cleaner 19 when the engine 10 is in its abrupt decelerating condition.

The air distributor 42 and the two-way valve 46 will then be described in more detail. The secondary air supply line 36 comprises a conduit **36*a* between the air pump 32 and the two-way valve 46, a conduit 36*b* between the valve 46 and the air distributor 42, and a conduit 36*c* between the air distributor and the air injection manifold 34. The two-way valve 46 comprises a generally cylindrical valve housing 50, the interior of which is divided into four members 50*a*, 50*b*, 50*c* and 50*d* by a diaphragm 52 and first and second partitions 54 and 56 all extending transversely of the axis of the housing 50. The diaphragm 52 is connected with the upper end of a valve stem 58*a* of a valve member which is of an inverted T-shape. The valve stem extends slidably and in an air-tight manner through an opening in the first partition 54 and also extends with a clearance through a central opening in the second partition 56. The underside of the second partition 56 around the central opening formed therein provides a valve seat which is engaged and disengaged by a valve head 58*b* of the valve member when the valve stem 58*a* is moved upwardly and downwardly by the diaphragm 52. The intake vacuum of the engine 10 produced in the intake passage 12 downstream of the throttle valve 14 is introduced through a vacuum conduit 60 into the second chamber 50*b* to bias the diaphragm 52 against a return spring 50*b*' disposed in the second chamber 50*b*. The conduit 36*a* for the pressurized air is connected at its downstream end to an opening formed in the peripheral wall of the fourth chamber 50*d*, while the second pressurized air conduit 36*b* is connected at its upstream end to an opening formed in the outer end wall of the fourth chamber 50*d*. An annular valve seat 36*b*' is provided on the inner surface of the outer end wall of the fourth chamber 50*d* around the opening to which the conduit 36*b* is connected so that the valve seat 36*b*' is engaged and disengaged by the valve head 58*b* of the valve member when the valve stem 58*a* is moved by the diaphragm 52. The air return conduit 44 is connected to the third chamber 50*c* in the valve housing 50. The first chamber 50*a* is vented to the atmosphere through an air vent hole 50*a*' formed in the housing 50. The diaphragm 52 is formed therein with a small orifice 52' through which the atmospheric air can flow from the first chamber 50*a* into the second chamber 50*b*** at a low rate.

The force of the spring **50*b*' is selected such that the vacuum produced in the intake passage 12 downstream of the throttle valve 14 at an abrupt deceleration of the engine 10 deforms the diaphragm 52 to the lowermost position. When the diaphragm is so deformed, the valve head 58*b* is lowered from the position shown (the position taken by the valve head during normal engine operation) to a position in which the valve head is in sealing engagement with the lower valve seat 36*b*' to disconnect the pressurized air line 36*a* from the pressurized air line 36*b* and simultaneously to communicate the pressurized air line 36*a* with the air return conduit 44 so that the pressurized air from the air pump 32 flows back into the air cleaner 19. During all the operating conditions of the engine 10 except the abrupt decelerating condition, the valve head 59*b* is located in its normal position shown to interrupt the communication between the third and fourth chambers 50*c* and 50*d* in the valve housing 50, so that the pressurized air from the air pump 32 flows from the chamber 50*d* through the line 36*b* to the air distributor 42**.

The air distributor 42 is constituted by an air distributing valve which is operative in response to variation in the engine intake vacuum to control the distribution of the pressurized air to the air injection manifold 34 and to the two-fluid injection nozzle 26. The air distributing valve 42 comprises a generally cylindrical valve housing 62 and a diaphragm 66 extending across the interior of the valve housing 62 to cooperate therewith to define a first or vacuum chamber 64 into which the engine intake vacuum downstream of the throttle valve 14 of the engine is introduced through a branch vacuum conduit 60' branched from the vacuum conduit 60. First and second partitions 68 and 70 are provided within the valve housing 62 and extend in parallel relationship with the diaphragm 66 to cooperate with the valve housing and the diaphragm to define second to fourth chambers 72, 74 and 76. The pressurized air conduits **36*b* and 36*c* are connected to openings formed in the peripheral wall and the outer end wall of the chamber 76 (i.e., the end wall of the valve housing opposite the partition 70), respectively, while the branch line 40 is connected to an opening formed in the peripheral wall of the third chamber 74. An annular valve seat 36c' is provided on the inner surface of the outer end wall of the fourth chamber 76 around the opening to which the air conduit 36c is connected. A central opening 70' is formed in the partition 70 in coaxial relationship with the valve seat 36c' to communicate the third and fourth chambers 74 and 76. The partition 68 axially slidably supports and guides a valve stem 78a of a valve member. The valve stem 78a is secured at the bottom end to the diaphragm 66 and connected at the upper end to a valve head 78b which is disposed within the chamber 76. This valve head 78b has an upper frusto-conical surface convergent toward the annular valve seat 36c', a lower frusto-conical surface convergent toward the central opening 70' in the partition 70, and an annular flange disposed between the upper and lower frusto-conical surfaces and extending radially outwardly therefrom. The upper and lower frusto-conical surfaces of the valve head 78b cooperate with the annular valve seat 36c' and the central opening 70' in the partition 70 to control the distribution of the pressurized air to the air conduit 36c and to the branch air line 40 and dependence on the degree of deformation of the diaphragm 66, respectively. When the valve head 78b is in its uppermost and lowermost positions, the annular flange of the valve head 78b is in sealing engagement with the annular valve seat 36c' and the upper surface of the partition 70 around the central opening 70' therein to cut off the flow of the pressurized air from the fourth chamber 76 into the air conduit 36c and into the branch air line 40, respectively. A spring 64' is provided in the vacuum chamber 64 to urge the diaphragm upwardly. The force of the spring 64' is selected such that, when the engine 10 is in its part-load normal operating condition, the valve head 78b is in its neutral position to permit the pressurized air from the air conduit 36b to flow through both of the annular valve seat 36c' and the opening 70' into the air conduit 36c and the branch air line 40 and hence to the exhaust port 20 of the engine 10 and the two-fluid injection nozzle 26. Thus, when the engine load is increased with a resultant decrease in the engine intake vacuum, the diaphragm 66 is upwardly deformed by the spring 64' to move the valve head 78b away from the opening 70' to a position where the valve head is nearer to the annular valve seat 36c' than is in the position shown. This positioning of the valve head reduces the supply of the pressurized air to the air injection manifold 34 and increases the supply of the pressurized air through the branch air line 40 to the two-fluid injection nozzle 26 whereby an increased quantity of the pressurized air is injected through the nozzle 26 together with the fuel into the intake ports 18 of the engine 10. As such, the supply of the pressurized air through the two-fluid injection nozzle 26 into the intake system of the engine 10 is increased as the load on the engine is increased, thereby to facilitate the atomization of the injected liquid fuel as well as to supercharge the engine whereby the volumetric efficiency of the engine is improved with resultant increase in the true or actual performance of the engine. On the other hand, when the engine load is decreased with a resultant increase of the engine intake vacuum, the distribution of the pressurized air to the air injection manifold 34** is increased for the reason inverse to the reason discussed above, thereby to increase the secondary air supply into the engine exhaust system whereby the purification of the engine exhaust gas is enhanced.

The pressure of from 0.4 to 0.6 kg/cm$^2$ of the pressurized air to be injected by the two-fluid injection nozzle 26 will be appropriate and sufficient to atomize the fuel injected with the air. Thus, excessive air is discharged from the branch air line 40 into the atmosphere through a pressure relief valve 80 provided on the branch air line between the ends thereof. A vacuum delay valve 86 is provided on the branch vacuum line 60' between the ends thereof. The vacuum delay valve 86 includes a fixed restriction 82 and a check valve 84 and is operative such that a variation in the intake vacuum of the engine toward a reduced level is transmitted with a certain delay to the diaphragm 66 in the vacuum chamber 64 of the air distributor 42 and such that a variation in the engine intake vacuum toward an increased level is immediately transmitted to the diaphragm 66.

FIG. 2 illustrates a second embodiment of the invention, in which parts similar to those of the first embodiment are designated by similar reference numerals. The differences of the second embodiment from the first embodiment are described hereinunder. An atmospheric air conduit 102 is connected to one inlet port of a change-over valve 104 which is provided on the branch air line 40 extending between the air distribution valve 42 and the two-fluid injection nozzle 26. The valve 104 is arranged such that, when the engine is in its part-load operating condition in which the engine intake vacuum is at a high level, the atmospheric air conduit 102 are communicated with the two-fluid injection nozzle 26 and such that, when the engine is in its full-load operating condition in which the intake vacuum is at a low level, the pressurized air from the air pump 32 is caused to flow to the two-fluid injection nozzle 26. More specifically the branch air line 40 consists of a conduit 140 between the air distribution valve 42 and the change-over valve 104 and a second conduit 142 between the change-over valve 104 and the two-fluid injection nozzle 26. The atmospheric air conduit 102 connects the change-over valve 104 to the intake passage 12 upstream of the throttle valve 14 of the engine. The change-over valve 104 is formed by an electromagnetic change-over valve operated by a computer 106 which is of a conventional structure and includes an electric switch (not shown) disposed therein. The computer 106 is arranged such that, when the engine intake vacuum transmitted to the computer through an extension 160 of the branch vacuum line 60' is higher than a reference pressure (i.e., when the engine is in its part-load operating condition), the electric switch in the computer referred to above is closed to allow the electric current from an electric source 162 to a solenoid (not shown) of the electromagnetic change-over valve 104 to electrically energize the solenoid so that the valve 104 is changed over to communicate the atmospheric air conduit 102 with the conduit 142. When the engine intake vacuum is lower than the reference pressure (i.e., when the engine is in its full-load or high-load operating condition), the electric switch in the computer 106 is opened to deenergize the solenoid of the change-over valve 104 so that the same communicates the pressurized air conduit 140 with the conduit 142.

With the arrangement discussed above, when the engine is in its part-load operating condition in which the engine intake vacuum is at a high level, the atmospheric air present in the intake passage 12 upstream of the throttle valve 14 flows therefrom through the atmospheric air conduit 102, the change-over valve 104 and the conduit 142 to the two-fluid injection nozzle 26 by which the atmospheric air is injected into the intake ports 18 together with the fuel. In this engine operating condition, because the magnitude of the engine intake vacuum is strong enough to produce a large relative velocity between the atmospheric air and fuel injected through the injection nozzle 26 and because a reduced quantity of fuel is injected into the engine, the atomization of the injected fuel can be achieved solely by the atmospheric air injected through the injection nozzle 26.

When the engine is in its high or full-load operating condition, the change-over valve 104 causes the pressurized air from the air pump 32 to flow through the conduit 142 to the two-fluid injection nozzle 26. In this engine operating condition, therefore, the second embodiment of the invention is operable in a manner similar to that of the first embodiment.

In the second embodiment of the invention, moreover, the conduit 142 has a portion 142*a* extending through an exhaust manifold 120 of the engine so that the air flowing through the conduit 142 to the two-fluid injection nozzle 26 is heated by the engine exhaust gases flowing through the exhaust manifold. Thus, the heated air is injected through the injection nozzle 26. This is advantageous in that the atomization of the injected fuel is further improved and that the two-fluid injection nozzle 26 itself is heated to prevent the occurence of icing at the nozzle. The fact that the atomization of the injected fuel is improved contributes to the reduction of the number of fuel injection nozzles required for an engine and makes it possible to dispose a single fuel injection nozzle in the intake passage upstream of the intake manifold rather than disposing a plurality of nozzles in respective intake ports of the engine. It should be noted that, because injected fuel was not sufficiently atomized in the prior art, it was desirable to provide a plurality of fuel injection nozzles in respective intake ports of an engine so as to facilitate uniform fuel supplies into respective engine cylinders.

As discussed above, the internal combustion engine according to the present invention employs a two-fluid injection nozzle as an injector for injecting a fuel into the engine. In addition, a part of a pressurized air to be supplied into the engine exhaust system is injected through the two-fluid injection nozzle into the engine to advantageously facilitate the atomization of the fuel injected by the nozzle as well as to supercharge the engine. It is to be noted that these advantages can be obtained by the addition of simple and inexpensive elements to conventional secondary air supply system for an internal combustion engine. The fact that the atomization of fuel is improved not only assures that the air-fuel ratio for the engine at a low temperature can be made larger (leaner) than in the prior art, but also ensures that a stable combustion in the engine can be obtained at a normal operating temperature even at a very lean air-fuel ratio and with a high EGR rate. Thus, the present invention contributes to improvements in fuel consumption, emission control and engine drivability.

What is claimed is:

1. An internal combustion engine comprising a secondary air supply system including an air pump for pressurizing air and a secondary air supply line through which the pressurized air is supplied as a secondary air into the engine exhaust system, and a fuel injection system including at least one injector disposed in the engine intake system and a fuel source operative to feed a fuel under pressure to said injector, wherein said injector is formed by a two-fluid injection nozzle operative to inject the fuel under pressure together with air, and wherein an air distributor is provided on said secondary air supply line between the ends thereof and said two-fluid injection nozzle is pneumatically connected to said air distributor by a branch air line, said air distributor being operative to cause the pressurized air to flow through said branch air line to said two-fluid injection nozzle at least in a highload engine operating condition.

2. An internal combustion engine according to claim 1, wherein said air distributor comprises an air distributing valve operative in response to variation in the engine intake vacuum to control the distribution of the pressurized air to said engine exhaust system and to said two-fluid injection nozzle, said air distributing valve being arranged such that the distribution of the pressurized air to said engine exhaust system is increased as the engine intake vacuum is increased and such that the distribution of the pressurized air to the two-fluid injection nozzle is increased as the engine intake vacuum is decreased.

3. An internal combustion engine according to claim 1 or 2, wherein said branch air line has a portion arranged such that the pressurized air flowing therethrough is in heat exchange relationship to a heat source.

4. An internal combustion engine according to claim 1 or 2, further including a change-over valve disposed on said branch air line between the ends thereof and an atmospheric air conduit connected at one end to said change-over valve, said change-over valve being arranged such that said change-over valve communicates said atmospheric air conduit with said two-fluid injection nozzle in a part-load engine operating condition in which the engine intake vacuum is at a high level and such that the change-over valve is changed over to cause the pressurized air from said air pump to flow to said two-fluid injection nozzle in a high-load engine operating condition in which the engine intake vacuum is at a low level.

5. An internal combustion engine according to claim 3, further including a change-over valve disposed on said branch air line between the ends thereof and an atmospheric air conduit connected at one end to said change-over valve, said change-over valve being arranged such that said change-over valve communicates said atmospheric air conduit with said two-fluid injection nozzle in a part-load engine operating condition in which the engine intake vacuum is at a high level and such that the change-over valve is changed over to cause the pressurized air from said air pump to flow to said two-fluid injection nozzle in a high-load engine operating condition in which the engine intake vacuum is at a low level.

6. An internal combustion engine according to claim 2, wherein said air distributing valve comprises a valve housing having an air inlet for the pressurized air from said air pump and two air outlets connected to said branch air line and to said secondary air supply line downstream of said air distributing valve, respectively, a diaphragm extending across the interior of said valve housing to cooperate therewith to define a vacuum chamber, and a valve member operatively connected to said diaphragm and having a valve head operative to simultaneously control the flows of the pressurized air through said two air outlets, said vacuum chamber being pneumatically connected by a vacuum line to the engine intake system downstream of said throttle valve, and wherein a vacuum delay valve is provided on said vacuum line and arranged such that a variation in the engine intake vacuum toward a reduced level is transmitted with a delay to said diaphragm and a variation in the engine intake vacuum toward an increased level is immediately transmitted to said diaphragm.

7. An internal combustion engine according to claim 3, wherein said air distributing valve comprises a valve housing having an air inlet for the pressurized air from said air pump and two air outlets connected to said branch air line and to said secondary air supply line downstream of said air distributing valve, respectively, a diaphragm extending across the interior of said valve housing to cooperate therewith to define a vacuum chamber, and a valve member operatively connected to said diaphragm and having a valve head operative to simultaneously control the flows of the pressurized air through said two air outlets, said vacuum chamber being pneumatically connected by a vacuum line to the engine intake system downstream of said throttle valve, and wherein a vacuum delay valve is provided on said vacuum line and arranged such that a variation in the engine intake vacuum toward a reduced leve is transmitted with a delay to said diaphragm and a variation in the engine intake vacuum toward an increased level is immediately transmitted to said diaphragm.

8. An internal combustion engine according to claim 4, wherein said air distributing valve comprises a valve housing having an air inlet for the pressurized air from said air pump and two air outlets connected to said branch air line and to said secondary air supply line downstream of said air distributing valve, respectively, a diaphragm extending across the interior of said valve housing to cooperate therewith to define a vacuum chamber, and a valve member operatively connected to said diaphragm and having a valve head operative to simultaneously control the flows of the pressurized air through said two air outlets, said vacuum chamber being pneumatically connected by a vacuum line to the engine intake system downstream of said throttle valve, and wherein a vacuum delay valve is provided on said vacuum line and arranged such that a variation in the engine intake vacuum toward a reduced level is transmitted with a delay to said diaphragm and a variation in the engine intake vacuum toward an increased level is immediately transmitted to said diaphragm.

9. An internal combustion engine according to claim 5, wherein said air distributing valve comprises a valve housing having an air inlet for the pressurized air from said air pump and two air outlets connected to said branch air line and to said secondary air supply line downstream of said air distributing valve, respectively, a diaphragm extending across the interior of said valve housing to cooperate therewith to define a vacuum chamber, and a valve member operatively connected to said diaphragm and having a valve head operative to simultaneously control the flows of the pressurized air through said two air outlets, said vacuum chamber being pneumatically connected by a vacuum line to the engine intake system downstream of said throttle valve, and wherein a vacuum delay valve is provided on said vacuum line and arranged such that a variation in the engine intake vacuum toward a reduced level is transmitted with a delay to said diaphragm and a variation in the engine intake vacuum toward an increased level is immediately transmitted to said diaphragm.

10. An internal combustion engine according to claim 1 or 2, further including a cut-off valve provided on said secondary air supply line between said air pump and said air distributor for interrupting the communication between said air pump and said air distributor on an abrupt deceleration of the engine.

11. An internal combustion engine according to claim 3, further including a cut-off valve provided on said secondary air supply line between said air pump and said air distributor for interrupting the communication between said air pump and said air distributor on an abrupt deceleration of the engine.

12. An internal combustion engine according to claim 4, further including a cut-off valve provided on said secondary air supply line between said air pump and said air distributor for interrupting the communication between said air pump and said air distributor on an abrupt deceleration of the engine.

13. An internal combustion engine according to claim 5, further including a cut-off valve provided on said secondary air supply line betwee said air pump and said air distributor for interrupting the communication between said air pump and said air distributor on an abrupt deceleration of the engine.

14. An internal combustion engine according to claim 6, further including a cut-off valve provided on said secondary air supply line between said air pump and said air distributor for interrupting the communication between said air pump and said air distributor on an abrupt deceleration of the engine.

15. An internal combustion engine according to claim 7, further including a cut-off valve provided on said secondary air supply line between said air pump and said air distributor for interrupting the communication between said air pump and said air distributor on an abrupt deceleration of the engine.

16. An internal combustion engine according to claim 8, further including a cut-off valve provided on said secondary air supply line between said air pump and said air distributor for interrupting the communication between said air pump and said air distributor on an abrupt deceleration of the engine.

17. An internal combustion engine according to claim 9, further including a cut-off valve provided on said secondary air supply line between said air pump and said air distributor for interrupting the communication between said air pump and said air distributor on an abrupt deceleration of the engine.

* * * * *